United States Patent [19]

Sloane

[11] 4,045,616

[45] Aug. 30, 1977

[54] VOCODER SYSTEM

[75] Inventor: Edwin A. Sloane, Los Altos, Calif.

[73] Assignee: Time Data Corporation, Santa Clara, Calif.

[21] Appl. No.: 580,479

[22] Filed: May 23, 1975

[51] Int. Cl.[2] ..... G10L 1/00

[52] U.S. Cl. ..... 179/1 SA; 235/156

[58] Field of Search ..... 179/1 SA; 235/156, 151.3

[56] References Cited

U.S. PATENT DOCUMENTS

| | | | |
|---|---|---|---|
| 3,360,610 | 12/1968 | Flanagan | 179/1 SA |
| 3,484,556 | 12/1969 | Flanagan | 179/1 SA |
| 3,581,078 | 1/1971 | Robison | 235/151.3 |
| 3,624,302 | 11/1971 | Atal | 179/1 SA |
| 3,638,004 | 1/1972 | Sloane | 235/156 |
| 3,702,393 | 1/1973 | Fuss | 235/152 |
| 3,925,648 | 12/1975 | Speiser | 235/156 |

OTHER PUBLICATIONS

Robinson et al, "A Computer Method of Z Transformers," IEEE Trans Aud and Electro AC, Mar., 1972.

Cooper et al, *Methods of Signal and System Analysis,* Holt, Rinehart & Winston, 1967.

*Primary Examiner*—Thomas W. Brown
*Assistant Examiner*—E. S. Kemeny
*Attorney, Agent, or Firm*—Stuart Lubitz

[57] ABSTRACT

The Laplace transform (s-plane) is obtained for contiguous or overlapping frames of speech (or other signals) and polepair parameters (frequency, damping, magnitude and phase) are selected for transmission so as to preserve maximum energy. Speech is reconstructed from the transmitted parameters, using, for example, a damped sine wave as the equivalent of a pole pair. No separate pitch determination is made, nor is a voiced-/unvoiced decision required.

32 Claims, 5 Drawing Figures

Fig. 1a
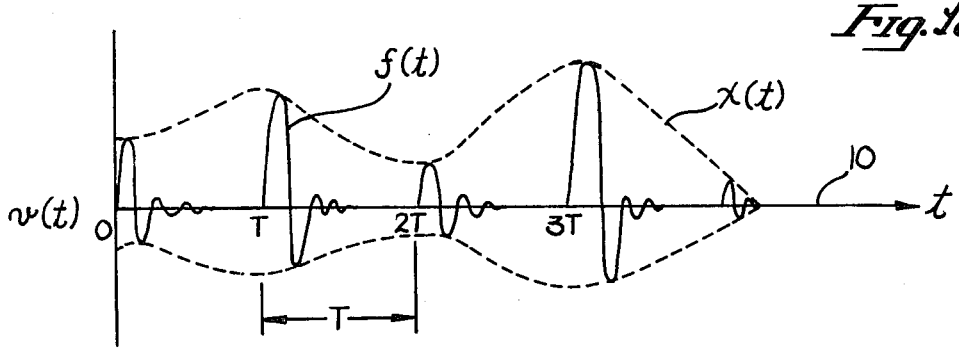
Fig. 1b
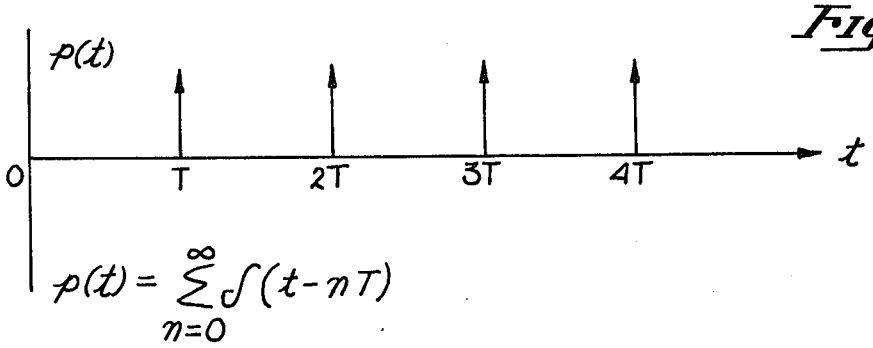
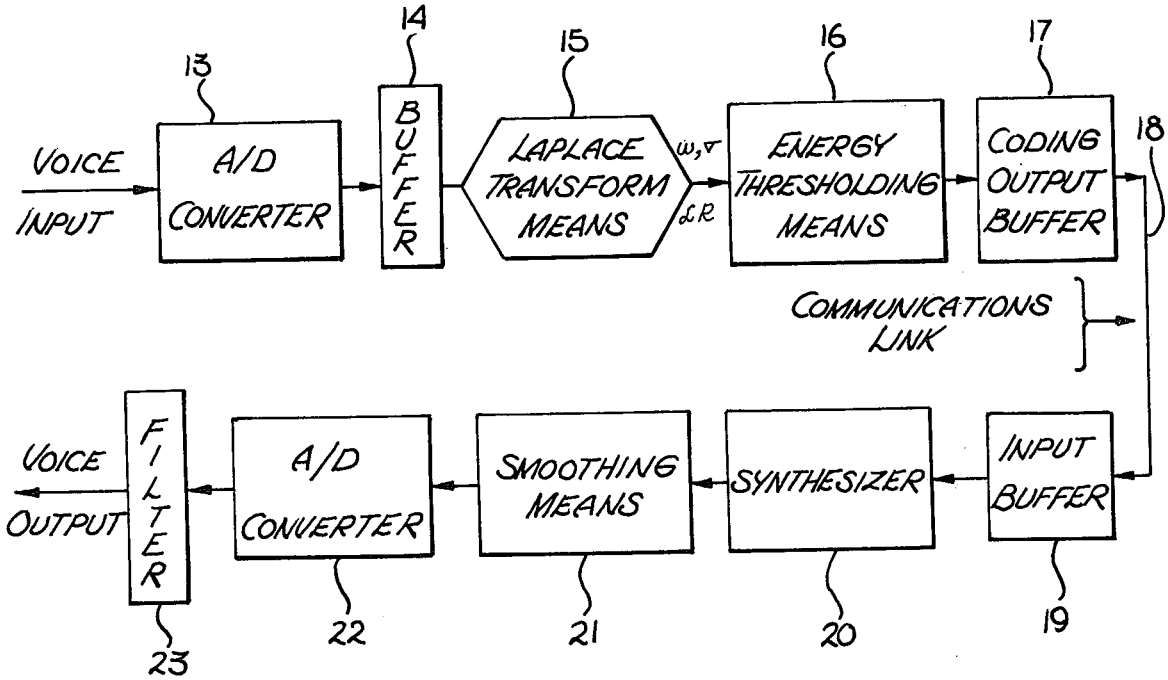
Fig. 2

VOCODER SYSTEM

BACKGROUND OF THE INVENTION

1. Field of the Invention

The invention relates to the fields of vocoders, transmitting analog signals in digital form and synthesizing analog signals.

2. Prior Art

Digitization of analog signals, particularly voice waveforms has become more emphasized in recent years. No doubt, this interest has been encouraged by the rapid development of digital circuits, the benefits inherent in digital transmission and the expectations of data compression. Moreover, digital voice channels more readily permit secured communications.

The so-called "vocoder" methods provide techniques for analyzing speech patterns which permit transmission, in digital form, of data used to synthesize voice. Vocoder methods generally operate differently upon voiced speech and unvoiced or fricative speech, thus a system must distinguish between these two speech forms and provide alternate means for unvoiced speech.

The vocoder methods for voiced speech determine a pitch component and data representing vocal tract structure known as the "formants." Both pitch extraction and determination of formant data have presented formidable problems, particularly where multiple voices and or interference including periodic noise are present.

In general, the prior art techniques have presented the separate determinations of pitch and formant data as prerequisites to vocoding. See *IEEE Spectrum,* October 1973, "Voice Signals: Bit-by-bit," pages 28–34; and *IEEE Spectrum,* August 1970, "Speech Spectograms Using the Fast Fourier Transform," pages 57–62.

The presently disclosed system does not require a determination between voiced and unvoiced speeh. Moreover, the system does not rely upon a separate pitch extraction.

SUMMARY OF THE INVENTION

In the disclosed vocoder system, the input speech signal (or other signal) is divided into frames of equal duration. A Laplace transform is taken on each frame, and the energy associated with each complex conjugate pole-pair is determined from the residue and damping rate. (The terms poles and pole-pairs are used interchangeably in the application. As may be seen from the model of the speech waveform each pole is in fact a pole-pair in the S-plane.) In one embodiment, the pole-pairs are ranked by energy, and the frequency, damping rate, magnitude and phase angle (and also the delay) for a number of pole-pairs, representing the highest energy, is transmitted. In another embodiment, the pole-pairs for transmission are selected by a thresholding means, after the input speech energy level is normalized. In the thresholding means, those poles whose energy content are above a predetermined level are selected for transmission. In the presently preferred embodiment, the Laplace transform is performed by "sharpening" the peaks of the Fourier transform representation of each frame of data. In this manner, interaction between the "skirts" of the peaks is minimized, allowing the frequencies (along the axis) of the peaks to be determined. For this information and using finite differencing computations, the pole location and residue are computed.

Synthesizing may be performed by computing time-domain amplitude values from the inverse Laplace transform, computed from the transmitted pole-pair data. Synthesizing may also be performed by summing the damped sinusoidal functions represented by the pole-pairs. In the presently preferred embodiment, such synthesis is performed in digital form in a recursive filter. Smoothing between frames is used to compensate for estimation errors and other perturbations.

One advantage of the present invention is that the quality of the synthesized waveforms may be improved by transmitting any desired number of pole-pairs. Thus, where greater bandwidth is available, reproduction quality may readily be improved without complex system changes. That is, the present invention permits variable bit rate transmission.

In actual tests, the system has been found to operate well even with background noise and with two (simultaneous) voices. Excellent quality voice reproduction has been proven with a 12,000 bits/second (corresponding to 16 pole-pairs), and reasonable synthesizing has been demonstrated at 2,400 bits/second.

BRIEF DESCRIPTION OF THE DRAWINGS

FIG. 1*a* illustrates a waveform of voiced speech; this particular speech model is used for purposes of mathematical explanation of the disclosed system.

FIG. 1*b* is a graph illustrating the pitch function associated with the waveform of FIG. 1*a*.

FIG. 2 is a general block diagram of a system implementing the present invention.

DETAILED DESCRIPTION OF THE INVENTION

Figure 3:
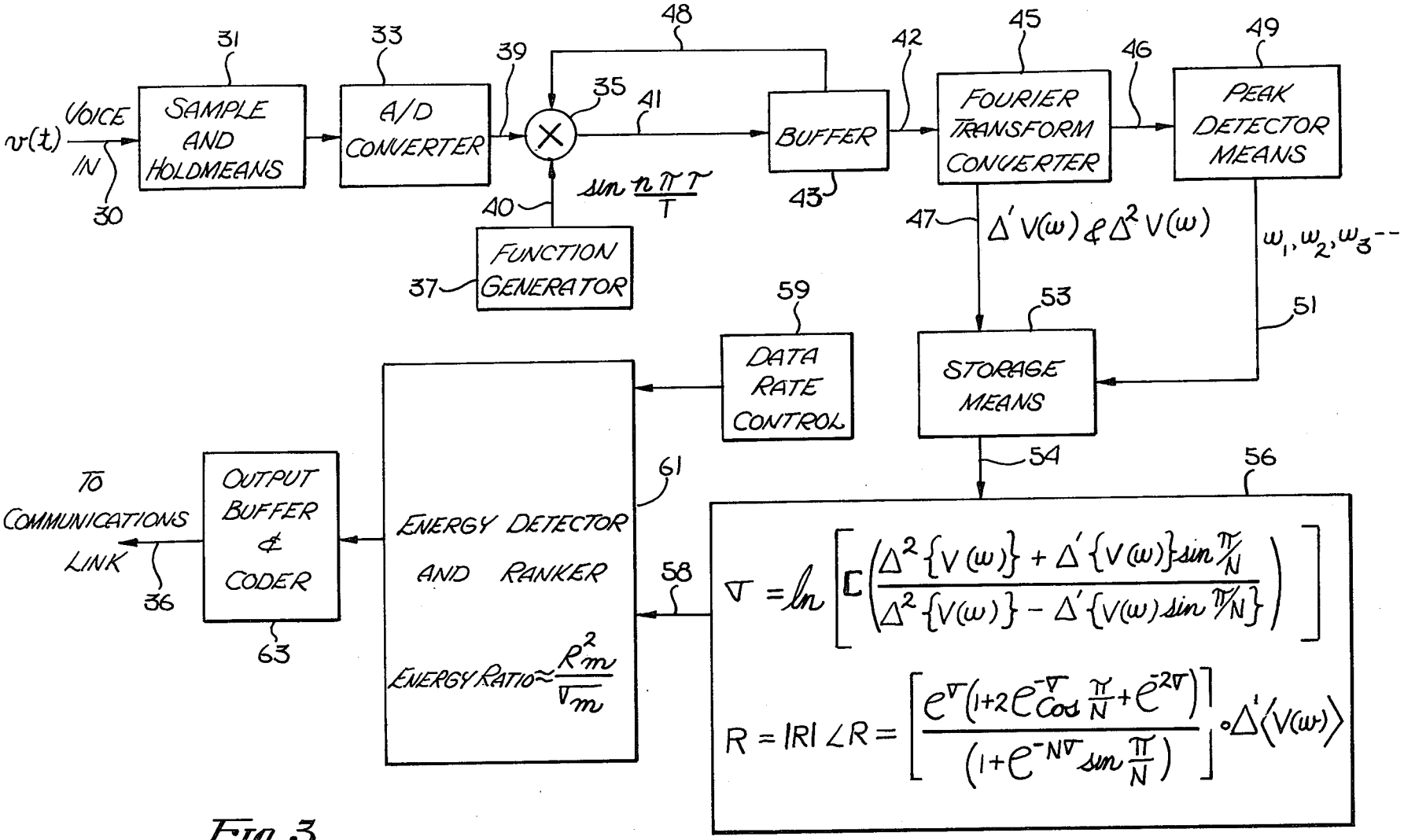
FIG. 3 is a detail block diagram for the presently preferred analyzer portion of the present invention.

A system and method for vocoding which utilizes the Laplace transform is disclosed. In general, the pole-pairs of each frame of speech are ranked in terms of their energy content, and a number of the highest rated pole-pair data (frequency $\omega$, magnitude R, damping rate $\sigma$, and phase angle $\phi$) are transmitted and used for synthesis. While the presently preferred embodiment of the invention is used for speech, the system and method may be used on waveforms representing other phenomena, such as music.

The following description, particularly the mathematical analysis, is based on a particular model of voiced speech shown in FIG. 1. The system and method does not distinguish between voiced speed and unvoiced speech, but rather treats the unvoiced speech in the same manner as voiced speech. While the following description does not provide the complex mathematical analysis to show that the unvoiced speech is reproduced by the system, in fact it, is, although the quality of the unvoiced speech is not, for the most part, as good as for voiced speech. However, since the total impression created by speech is primarily the result of voiced speech, the presently disclosed system and method provides an excellent vocoder system.

Referring to FIG. 1*a* and the voiced speech model shown on line 10, a mathematical analysis of this speech model is helpful in understanding the present invention and its departure from the prior art. The speech signal or waveform $v(t)$ is shown having a periodic structure modulated by an envelope weighing function $x(t)$. The speech model includes a periodic pitch function, $p(t)$ having a period of T (shown separately in FIG. 1*b*), and a format function $f(t)$. The speech model of FIG. 1*a* may be written as:

$$v(t) = \left\{ f(t) * \sum_{n=0}^{\infty} \delta(t - nt) \right\} x(t) \tag{1}$$

Where the symbol "*" represents a convolution. If the formant function is written in terms of complex exponentials as:

$$f(t) = \sum_{m} R_m e^{\alpha_m t} \tag{2}$$

for values of $t$ greater than zero, the Laplace transform of equation (1) becomes:

$$V(s) = \left\{ \sum_{m} \frac{R_m}{s - \alpha_m} \cdot \frac{1}{1 - e^{-st}} \right\} * X(s) \tag{3}$$

Again, where the symbol "*" represents a convolution, now however, in the frequency domain. In equation (1) the mathematical process of convolution replicates the formant function at the same spacing in time as the delta function, while in equation (3) the convolution replicates the formant function at the same spacing in frequency. Since the pitch poles fall on the j $\omega$ axis, the pitch term may be rewritten as follows:

$$\frac{1}{1 - e^{-st}} = \frac{1}{T} \sum_{k=-\infty}^{+\infty} \frac{1}{s - j\frac{2\pi k}{t}} \tag{4}$$

Thus, equation (3) becomes:

$$V(s) = \frac{1}{T} \left\{ \sum_{m} \sum_{k} \frac{R_m}{(s - \alpha_m)(s - j\frac{2\pi k}{T})} \right\} * X(s) \tag{5}$$

Or, in terms of partial fractions, equation (5) becomes:

$$V(s) = \frac{1}{T} \left\{ \sum_{m} \sum_{k} \frac{R_m}{\beta_k - \alpha_m} \left[ \frac{1}{s - \beta_k} - \frac{1}{s - \alpha_m} \right] \right\} * X(s) \tag{6}$$

where $\beta_k = j\frac{2\pi k}{T}$.

This equation may be expressed without the convolution since in general:

$$\frac{1}{s - \gamma} * X(s) = X(s - \gamma) \tag{7}$$

Equation (5) becomes:

$$V(s) = \frac{1}{T} \sum_{m} \sum_{k} \frac{R_m}{\beta_k - \alpha_m} [X(s - \beta_k) - X(s - \alpha_m)] \tag{8}$$

From equation (1) it may be seen that for the assumed speech model, voiced speech may be expressed as periodically shifting poles off the envelope weighting function.

The energy associated with each pole is approximately proportional to the squared magnitude of the residue and inversely proportional to the damping rate.

Equations (5) and (8) indicate that the pitch poles are more determinative of the energy than the formant poles. The pitch poles ($\beta_k$) are undamped (located on the $j\omega$ axis), whereas the formant poles ($\alpha_m$) are off the $j\omega$ axis; thus for an approximation, ignoring the formant poles, equation (7) may be rewritten as:

$$V(s) \approx \frac{1}{T} \sum_{k} \sum_{m} \frac{R_m}{\beta_k - \alpha_m} X(s - \beta_k) \tag{9}$$

From equation (9) it may be concluded that the more significant poles are the periodic set associated with the envelope function $x(t)$. However, these poles are weighted by the residues and distances from each of the formant poles; thus, formant information is preserved even though the more heavily damped formant poles are not retained. The formant information is implicitly represented by the resultant complex residues; the pitch information is implanted in the residue and pole distribution.

In practice, the actual number of pole-pairs retained for approximating a segment of speech would be some sub-set of those implied by equation (8). The Laplace transform computation solves for the total weighted periodic set, and from this selects a number of pole-pairs together with their complex residues so as to retain the maximum energy possible for that given number of poles. In other words, the voice signal represented by equation (8) is analyzed and a set of parameters is obtained that represent equation (8) in a partial fraction expansion form.

Thus, if:

$$X(s) = \sum_{l} \frac{A_l}{s - \gamma_l} \tag{10}$$

$$V(s) = \frac{1}{T} \left[ \sum_{k} \sum_{l} \frac{\sum_{m} \frac{A_l R_m}{\beta_k - \alpha_m}}{s - \gamma_l - \beta_k} - \sum_{m} \sum_{l} \frac{\sum_{k} \frac{A_l R_m}{\beta_k - \alpha_m}}{s - \gamma_l - \alpha_m} \right] \tag{11}$$

or in the approximation form as expressed by equation (9):

$$V(s) \approx \sum_{k} \sum_{l} \frac{K_{k,l}}{s - \lambda_{k,l}} \tag{12}$$

where $\{K_{k,l}\}$ is the set of complex residues and $\{\lambda_{k,l}\}$ is the set of pole locations, which characterize the speech. The system solves for these two sets of complex numbers. It may be desirable in some application to use equation (11) to determine pole-pair locations and residues with the simplifying assumption inherent in equation (12).

The energy associated with each pole-pair may be shown to approximately be proportional to:

$$E \approx \frac{|R_m|^2}{\sqrt{m}} \tag{13}$$

where ($R_m$) is the amplitude to the residue and $\sigma_m$ the damping rate.

In practice, the number of output pole-pairs from the Laplace transform means for each frame of speech is compared to the number of pole-pairs that are to be transmitted. If the number of pole-pairs from the Laplace transform means is greater than the number of pole-pairs to be transmitted, the energy associated with each pole-pair is calculated and the pole-pairs are ranked in terms of their energy content. A fixed number of the highest ranked pole-pairs (those having the highest energy) are preserved for transmission.

Thus, the vocoder system is based on obtaining a Laplace transform partial fraction expansion analysis of sequential segments of speech, retaining and transmitting a number of pole-pair parameters (frequency, damping, magnitude and phase) based on preservation of maximum energy and then reconstructing the speech signal by generating a voice signal corresponding to the transmitted parameters. This is done on contiguous-uniform durations of speech with appropriate smoothing between segments in the presently preferred embodiment; however, overlapping frames of speech may be used as a technique for providing smoothing between frames.

The above mathematical analysis shows that even where the more heavily damped pole-pairs are not used, the formant information is preserved, thus the present system does not utilize separate pitch and formant determinations.

Referring first to FIG. 2 where the invented system is illustrated in general block diagram form, the analog-to-digital converter 13, buffer 14, Laplace transform means 15, energy thresholding means 16 and the coding output buffer 17 comprise the analyzer portion of the system. This portion of the system receives an analog voice, input signal which is vocoded for transmission or storage. A communication link, shown as line 18 in FIG. 2, coupled the analyzer portion of the system with the synthesizer portion of the system. The synthesizer portion comprising an input buffer 19, synthesizer 20, smoothing means 21, digital-to-analog converter 22 and a filter 23. The communication link is not discussed in any detail in the application and may be any of numerous transmission means, such as radio or microwave link, or, may be a recording means for recording the vocoded information.

In FIG. 2, the voice input signal is assumed to be an analog voice signal which is applied to the analog-to-digital converter 13. The converter 13 periodically samples the input voice signal and converts each sample to digital form, and communicates each digitized sample to buffer 14. In the presently preferred embodiment buffer 14 stores a predetermined number of samples corresponding to a frame, for example, a thousand samples may be utilized for each of a plurality of contiguous frames. In one embodiment of the present invention, the input voice signal is gain or amplitude normalized and a separate gain factor is transmitted through the system to the synthesizers. The converter 13 and buffer 14 may be known means, commercially available.

Each frame of digital information from buffer 14 is applied to the Laplace transform means 15. A Laplace transform is performed on each frame of data within means 15, and the pole-pairs are thus defined (that is, the location and complex residue of each pole is determined). Laplace transform means 15 may be a digital computer, programmed for performing a Laplace transform, or may be special purpose hardware. Known software programs or algorithms such as the MAP51 produced by TIME/DATA CORPORATION and used on the DEC 11/35 computer manufactured by Digital Equipment Corporation, may be utilized by the Laplace transform means 15, although in the presently preferred embodimemt the Laplace transform means is as shown in copending application Ser. No. 700,446, filed June 28, 1976, which is continuation-in-part of Ser. No. 389,510, filed Aug. 20, 1973 now abandoned.

The pole-pair information from Laplace transform means 15 is then communicated to the energy thresholding means 16. Within the means a number of pole-pairs are selected for transmission to the coding output buffer 17. This selection is determined on the basis of the energy associated with each of the pole-pairs, as previously discussed. In the presently preferred embodiment, either one of two methods are utilized for selecting the pole-pairs for transmission. In one embodiment, particularly where the input voice signal has been gain normalized, a predetermined energy threshold level is set within means 16, and only these pole-pairs whose energy exceed this threshold are coupled to buffer 17. In another embodiment, a fixed or variable number of pole-pairs is selected by the energy thresholding means 16 and communicated to the buffer 17. By way of example, assume that the communication link is to transmit 12,000 bits per second and that this corresponds to approximately 16 pole-pairs of information per frame. Energy thresholding means 16 would then rank the pole-pairs from transform means 15 in terms of their energy content, as determined by equation 13, and select the first 16 pole-pairs, that is those containing the most energy, for transmission to buffer 17. It will be appreciated that for some input frame the Laplace transform means 15 may not be able to define or locate 16 pole-pairs for transmission to the energy thresholding means 16. This may occur during a period of silence, or uncomplicated speech waveforms.

The coding output buffer 17 receives the pole-pair information from the energy thresholding means 16 and codes it for transmission over the communications link. Any one of numerous encoding methods may be utilized. For example, it may be desirable to transmit the frequency information in logarithmic form, or to transmit some or part of the pole-pair information in the form of a difference when the information is compared to the pole-pair information of the preceding frame.

The input buffer 19 receives the information from the communications link or, for that matter, from a storage means and decodes the information where appropriate. The output from the input buffer is applied to a synthesizer 20.

In the presently preferred embodiment, as will be discussed in more detail, a recursive filter is used which permits digital circuitry to be utilized for synthesizing the waveform without first obtaining an inverse Laplace transform.

Another system which may be utilized for synthesizing speech from the pole-pair information may include: first, a means for converting the input signal to synthesizer 20 to a time-domain function through use of an inverse Laplace transform or other transform; and a computational means for computing the amplitude values associated with each of the pole-pairs for each time increment. By summing the amplitude contribution for each time increment associated with each of the pole-pairs the voice signal may be synthesized. In general, since each of the pole-pairs may be represented in the time-domain by a damped sinusoid, the damped sinusoid represented by each pole-pair may be regenerated and summed (with the appropriate phase angle) with the other damped sinusoids represented by the other pole-pairs to generate the voice signal.

The smoothing means 21 may be any means for providing a smooth transition from one frame to the next. One method of providing a smooth transition is to utilize overlapping frames rather than contiguous frames. The analog-to-digital converter 13 along with buffer 14 may be utilized to provide overlapping frames to the Laplace transform means 15. Within smoothing means 21, the end of each frame, and the beginning of the next frame are tapered and then summed for the overlapping period to provide smoothing. This type of smoothing has been utilized in vibration control systems and is described in U.S. Pat. No. 3,848,115 (referred to as windowing means). Other smoothing techniques may be utilized, such as normalized gain techniques or other techniques known in the prior art.

The output from the smoothing means 21 is applied to the digital-to-analog converter 22 wherein the frames of digital information are converted to analog form as its customary in the art. The output analog signal from the digital converter 22 is applied to filter 23 and filtered in an ordinary manner. Filter 23 may be utilized to remove frequency components introduced into the signal by the system. For example, the filter 23 may eliminate the frequency associated with the sampling rate of the analog-to-digital converter 13 and its harmonics, or other such signals.

Thus, the system discussed in conjunction with FIG. 2 may be utilized to vocode an input signal, and to synthesize the coded signal without a separate pitch determination, and where voiced and unvoiced speech are handled in the same manner.

In FIG. 3, the analyzer portion of the system in its presently preferred embodiment is illustrated in detail. The analyzer receives an input signal, for example, an analog voice signal, $v(t)$, on line 30, and provides an output signal (line 36) at the output of the output buffer and coder 63. This output may be coupled to a communications link or recording system. As in the case of the system of FIG. 2, the output signal on lead 36 is representative of a plurality of pole-pairs, selected so as to maximize the energy of the input signal. However, in the presently preferred embodiment, a Laplace transform is determined from use of a Fourier transform.

The input to the analyzer, line 30, is coupled to a sample-and-hold means 31. Sample-and-hold means 31 may be any one of a plurality of known circuits for sampling an input signal, and for holding the sample for a sufficient time for the sample to be converted to digital form by the analog-to-digital converter 33. Thus, the output from the sample-and-hold means 31 is coupled to the input of an analog-to-digital converter 33. Converter 33 may utilize commercially available analog-to-digital converter circuits.

The output line from the analog-to-digital converter 33 is coupled to an input terminal of multiplication means 35. Multiplication means 35 includes input terminals coupled to lines 39, 40 and 48, and an output terminal coupled to line 41. Multiplication means 35 multiplies the digital signal on line 39 or line 48 with the digital signal on line 40 and provides a signal representative of a product on line 41. Known digital multiplication means and multiplexing means may be utilized for multiplication means 35.

The output terminal of multiplication means 35 is coupled to a buffer 43. Buffer 43 is a storage means used for storing digital information. The output of buffer 43 is coupled to converter 45 by line 42. The buffer 43 may be any one of a plurality of known storage means for storing digital signals, such as a shift register, random-access memory, core memory, or the like.

Function generator 37 generates digital signals representative of a known function. In the presently preferred embodiment the function generator 37 generates a sine function, which is coupled to the multiplication means 35 by line 40. This function is shown as sin $(\eta\pi\tau)/T$ in FIG. 3 where $\tau$ is the sampling period of the sample-and-hold means 31.

The converter 45 may be any one of a plurality of computer means adaptable for obtaining a Fourier transform of an input signal. Numerous fast Fourier transforms (FFT) means are known in the prior art which may be implemented either in hard-wired form or in software form. Thus, the converter 45 may be a general purpose digital computer programmed with an FFT software program. In the presently preferred embodiment, the Fourier transform converter 45 comprises the system disclosed in U.S. Pat. No. 3,638,004. Numerous other FFT techniques are disclosed in the prior art section of this patent, and in the references cited. Also, in U.S. Pat. No. 3,638,004, a function generator is illustrated in FIG. 7 which may be utilized for function generator 37, and a sample-and-hold means and analog-to-digital converter, which may be utilized for sample-and-hold means 31 and analog-to-digital converter 33 is illustrated in FIG. 6.

As will be discussed in more detail, converter 45 obtains a Fourier transform of the signal on lead 42. However, the signal on lead 42 is not simply the digital form of the input signal applied to line 30, but rather the signal applied to line 30 after that signal has been operated upon by multiplication means 35 in conjunction with the output of the function generator 37.

The output terminals of Fourier transform converter 45 are coupled to the input terminal of peak detection means 49 by line 46, and to an input terminal of storage means 53 by line 47.

The peak detection means 49 may be any one of a plurality of digital means for determining the peaks of a signal. Peak detection means 49 detects the peaks for each frame of input data received by it upon line 46. The output terminal of the peak detection means 49 is coupled to the other input terminal of storage means 53 by line 51.

Storage means 53 may be a digital means for storing information such as a random-access memory, plurality of shift registers, magnetic core memory or like means.

Arithmetic means 56 is used for performing ordinary arithmetic functions, and hence, may be a general purpose digital computer, a hard-wired computer, or other digital means. The input terminal of the arithmetic means 56 is coupled to the output terminal of storage means 53 by line 54. In the presently preferred embodiment, a general purpose digital computer is utilized for performing the arithmetic functions set out by the equation shown within the arithmetic means 56. These equations involve ordinary arithmetic functions such as multiplication, division, addition, logarithm computation, and hence, known algorithms may be readily adapted for this purpose. The output terminal of arithmetic means 58 is coupled to the energy detector and ranker 61.

Energy detector and ranker 61 is a digital circuit means for computing the energy associated with each pole-pair from the pole-pair characteristics information supplied to the input terminal of ranker 61. The energy associated with each pole is computed by the performance of a multiplication and division operation which in the presently preferred embodiment is performed in a general purpose digital computer common with arithmetic means 56, however, a separate hard-wired circuit may be utilized. Ranker 61 also ranks the poles in terms of energy by comparing the energy of each pole-pair within a frame, and then transmits the pole-pair parameters of the higher energy poles to the output buffer and coder 63.

Data rate control 59 is a manual control or an automatic control for providing a signal to ranker 61 representative of the number of pole-pairs to be communicated to the output buffer and coder 63. While in the presently preferred embodiment a fixed number of pole-pairs are selected for each frame of input signal (such as 16) in some applications it may be desirable to vary the number of pole-pair transmitters for each frame.

The output buffer and coder 63 receives information from the energy detector in ranker 61 at its input terminal and codes the information in any suitable form for transmission to the communications link on line 36. Any one of numerous well-known circuits may be used for buffer and coder 63.

As will be appreciated, timing signals and control signals are applied to all the circuit means of FIG. 3, but have not been illustrated in FIG. 3 in order not to overcomplicate the drawing. Known timing circuits and logic means may be utilized for controlling the flow of data through the analyzer shown in FIG. 3. In operation, an analog voice signal is applied to the sample-and-hold means 31 on line 30. In the presently preferred embodiment illustrated in FIG. 3, a gain adjustment is not made in the sample-and-hold means 31 for normalizing the gain as previously mentioned. If such an adjustment or normalization of the input voice signal is desired, a separate signal representative of the gain of the input signal, for each frame, would be transmitted to the output buffer and coder 63 along with the information representing the pole-pairs. In such a system, the energy detector and ranker 61 may simply provide a threshold level and permit the communications to the output buffer and coder 63 of all pole-pairs having an energy level above a predetermined energy level. In the presently preferred embodiment, the sample-and-hold means, by way of example, samples 500 samples per frame (50 millisec. contiguous frames). In the analog-to-digital converter 33, each sample is converted to digital form and then communicated to the multiplication means 35.

As will be appreciated, each frame of the input voice signal is operated upon separately and the pole-pairs determined for that frame, although a "pipeline" scheme is utilized. That is, while the Fourier transform converter 45 may be operating upon one frame of the input signal, the sample-and-hold means, analog-to-digital converter 33, function generator 37 and multiplication means 35, may be operating upon the next frame of the input signal.

In the presently preferred embodiment, the pole location and their residues, specifically, the frequency, damping rate, phase angle and magnitude are determined by computer means disclosed in the above-referenced copending application Ser. No. 700,446. Even more specifically, the finite differencing computational method described in this copending application is utilized for the embodiment illustrated in FIG. 3. For this reason, the detailed operation of generator 37, multiplication means 35, buffer 43, converter 45, peak detection means 49, storage means 53 and arithmetic means 56 shall only be briefly described.

Each frame of the input signal after being digitized is multiplied by a sine function generated by function generator 37 within multiplication means 35 and the resultant product signal is coupled to buffer 43. This product signal is then communicated on line 42 to the Fourier transform converter 45, and also is returned to multiplication means 35 on line 48 where the product signal is multiplied, again by a sine function generated by function generator 37. This second product signal is communicated to buffer 43 (on line 41) and subsequently communicated to the Fourier transform converter 45 on line 42.

The Fourier transform converter 45 obtains a Fourier transform of both the first product and second product signals communicated to it from buffer 43 for each frame of the input signal. The results of both transforms are communicated to storage means 53 on line 47 and the results of the transform for the second product signal are communicated to peak detection means 49 on line 46. Mathematical representations of these signals are shown adjacent to line 47 in FIG. 3. Note that $\Delta$ represents the finite differencing operator used in the presently preferred embodiment.

As explained in more detail in the above identified application, the multiplication in time-domain performed by the multiplication means 35 sharpens the peaks of the frequency domain representation of the input signal. This sharpening lessens the interference caused by the skirts of adjacent peaks, and allows the determination of the frequency of the poles along the $j\omega$ axis within peak detection means 49. Thus, for each frame of input data the peak detection means 49 determines the frequencies at which the poles occur. These frequencies are transmitted on line 51 into the storage means 53 where they are placed in storage. The first and second "differencing" or convolution (resulting from the first and second product signals) are utilized in the analyzer of FIG. 3, however, as is explained in the above identified application higher differences may be used.

The storage means 53 communicates the frequencies and the results of the Fourier transform conversions on line 54 to the arithmetic means 56. The arithmetic means solves the two equations shown within that block for each frame of data. In the "Sigma" equation, the quantity N is the number of samples per frame and C is a scale factor. In the second equation "R" is equal to the absolute magnitude of the amplitude (of the pole) and the phase angle of the pole.

The information, that is the frequency, damping rate, amplitude and phase angle for each pole-pair is then communicated on line 58 to the energy detector and ranker 61. Within this means, the energy associated with each of the pole-pairs is determined and the pole-pairs are ranked, that is stored, and identified in terms of their relative energy content. Control means 59 determines the number of poles which are transmitted to the output buffer and coder 63 and for each frame some preselected number of pole-pair data is transmitted to the output buffer and coder 63. As previously mentioned, 16 pole-pairs have been found to provide excellent reproduction with frame duration of 50 milliseconds.

The output buffer and coder 63 is used to interface the analyzer with a communications link, or recorder and to place the pole-pair information in identifiable form. An identified word may be used to identify the start of each frame, and other identifier words may be used to identify the beginning of the data defining each of the pole-pairs.

In some applications it has been found to be more economical to compute the pole-pair information in "two-passes." First a rough computation of the pole-pair information is made and the higher energy poles are selected. Then in a second pass more precise definition of the selected poles is made. It is apparent that during the second pass the computations are reduced since detail computations are only required to more accurately define the selected pole-pairs. In still another application it may be desirable to obtain the frequencies of the poles from a Fourier transform without the sharpening previously discussed.

Figure 4:
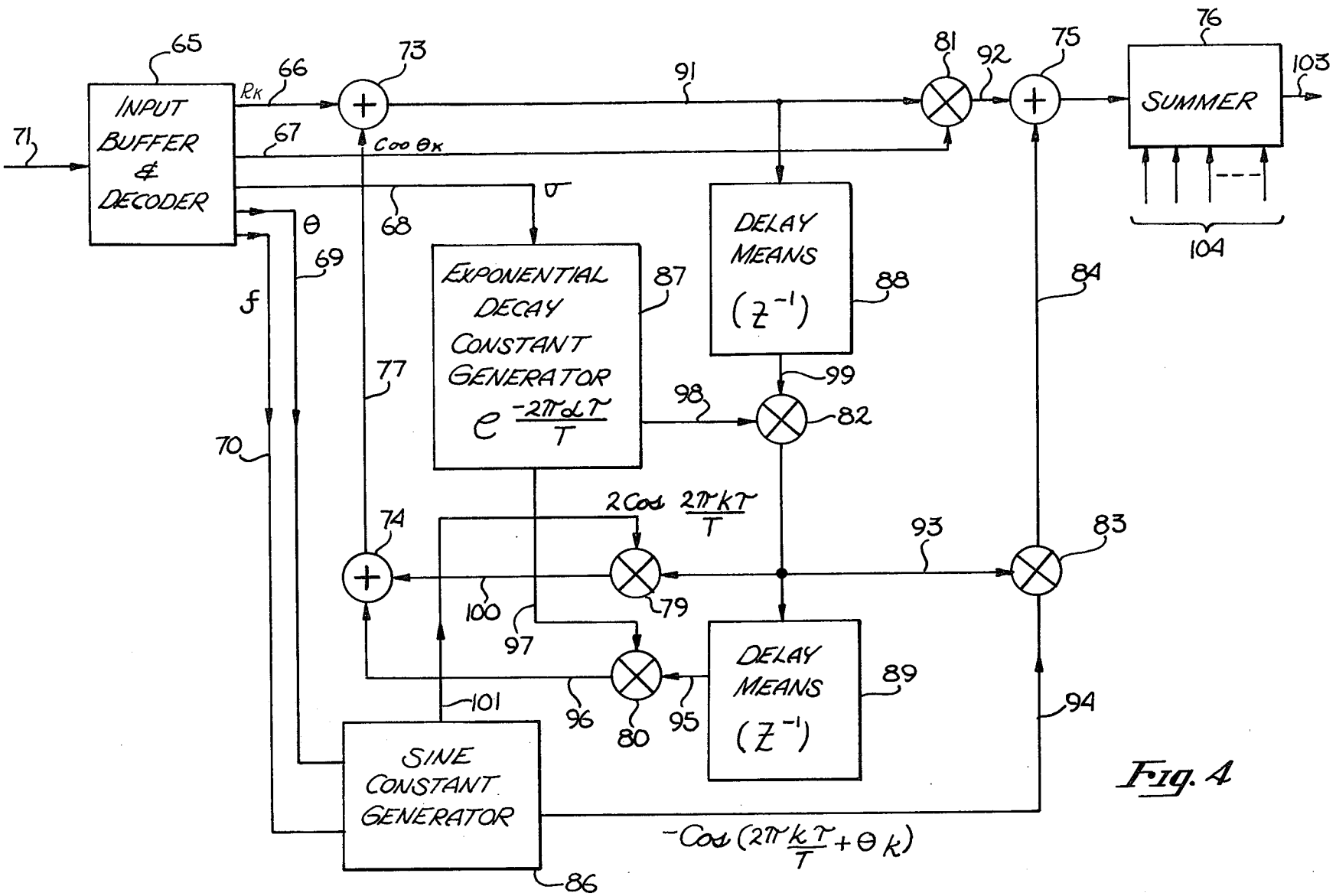
FIG. 4 is a detail block diagram for the presently preferred synthesizer portion of the present invention.

In the presently preferred embodiment of the synthesizer, the synthesis is performed without obtaining an inverse Fourier transform or inverse Laplace transform, but rather by generating sine functions and exponential functions corresponding to the pole-pair information. A recursive filter shown in FIG. 4 is used for this purpose; the filter receives input information from the communication link or storage means on line 71, this line being coupled to the input terminal of an input buffer and decoder 65. The output signal is applied to line 103, this line being coupled to the output terminal of a summer 76. Known digital circuits may be utilized for the fabrication of the circuit of FIG. 4.

It may be shown that the synthesized speech may be represented by the following equation, where Z represents the Z-transform operator:

$$V_k(Z) = R_k \frac{\cos\theta_k - e^{\frac{-2\pi\alpha_k\tau}{T}} \cos\left(\frac{2\pi\tau k}{T} + \theta_k\right) Z^{-1}}{1 - 2e^{\frac{-2\pi\alpha_k\tau}{T}} \cos\frac{2\pi k\tau}{T} Z^{-1} + e^{\frac{-4\pi\alpha_k\tau}{T}} Z^{-2}} \quad (14)$$

where $\tau$ is the sampling interval, and the frequency, $f_k$ and damping constant, $\sigma_k$, are respectively given by $$f_k = \frac{k}{T} \text{ and } \sqrt{k} = \frac{2\pi\alpha_k}{T} \quad (15)$$

Numerous terms of this equation have been shown in the circuit of FIG. 4 to assist in understanding that circuit and the fact that the circuit implements equation 14.

Input buffer and decoder 65 includes five output terminals coupled to lines 66 through 70. The input buffer and decoder 65 receives the information representing a pole-pair and applies the amplitude to line 66, the cosine of the phase angle to line 67, the damping rate to line 68, the phase angle to line 69, and the frequency to line 70.

Adder 73 includes two input terminals and an output terminal, the input terminals are coupled to line 66 and line 77 and the output terminal is coupled to line 91.

Delay means 88 and 89 may be shift registers or other means for delaying digital signals. These means are used to delay the signal applied to the input terminal of the delay means by a time corresponding to the sampling period. The input terminal of delay means 88 is coupled to line 91, while the input terminal of delay means 89 is coupled to line 93. The output terminal of delay means 88 is coupled to line 99, while the output terminal of delay means 89 is coupled to line 95.

Five multiplication means, multipliers 79, 80, 81, 82 and 83 are used in the recursive filter of FIG. 4. Each of these multipliers include two input terminals and an output or product terminal. Multiplier 79 has its input terminals coupled to line 93 and line 101 and its output terminal coupled to line 100. Multiplier 80 has its input terminals coupled to lines 95 and 97 and its output terminal coupled to line 96. Multiplier 82 has its input terminals coupled to lines 98 and 99 and its output terminal coupled to line 93. Multiplier 81 has its input terminals coupled to lines 91 and 67 and its output terminal coupled to line 92; and, multiplier 83 has its input terminals coupled to lines 93 and 94 and its output terminal coupled to line 84.

In addition to adder 73, the recursive filter of FIG. 4 utilizes adders 74 and 75, each of which includes a pair of input terminals and an output terminal. Adder 74 has its input terminals coupled to lines 96 and 100 and its output terminal coupled to line 77, while adder 75 has its input terminals coupled to lines 92 and 84 and its output terminal coupled to the input terminal of summer 76.

The constant sine generator 86 generates constant digital signals which are representative of the equations shown adjacent to lines 94 and 101 of FIG. 4. This generator receives a frequency input corresponding to the frequency of a pole on line 70, and a phase angle input signal on line 69. The two sine functions generated by sine generator 86 are applied to lines 94 and 101. Both the output signal from sine generator 86 are shown in the form of a cosine in FIG. 4. One of these signals (line 94) is shifted by the phase angle of the pole.

The exponential constant generator 87 generates, in digital form, a constant signal corresponding to the exponent shown within generator 87.

Timing means not shown are coupled to each of the circuit means of FIG. 4 in order to control the flow of information from one means to another.

The circuit of FIG. 4 upon receiving the characteristics of a single pole-pair operates upon this information and produces an output signal at the output of adder 75. The circuit is clocked through increments corresponding to increments used in sampling the input analog signal, and hence receives new pole-pair information for each frame of input signal. A recursive filter such as shown in FIG. 4 may be utilized for each pole-pair and the output of each such filter is summed within summer 76. For example, if 16 pole-pairs are transmitted, 16 circuits similar to that shown in FIG. 4 are utilized with the output of each being coupled to lines 104 for summing within summer 76. The output from summer 76, line 103, is then converted to analog form.

Thus, a vocoder has been disclosed which does not require a separate pitch determination and which operates upon unvoiced speech in the same manner as voiced speech.

I claim:

1. A vocoder system comprising:

input means for receiving an input signal;

time-domain to frequency-domain transformation means for determining s-plane pole locations and residues for said input signal coupled to said input means and for providing an output signal representative of such pole locations and residues; and synthesizing means for synthesizing a signal from said output signal representative of such pole locations and residues, coupled to said transformation means;

whereby a signal representative of voice or the like may be stored or transmitted in the form of s-plane parameters.

2. A system for transmitting an input signal in a coded form comprising:

Laplace transform means for computing the Laplace transform of said input signal and for providing an output signal representative of the pole-pairs of said input signal; and thresholding means, coupled to said Laplace transform means for selecting pole-pairs from said output signal of said Laplace transform means for transmission;

whereby said input signal may be transmitted in the form of selected pole-pairs.

3. The system defined by claim 2 wherein said thresholding means selects pole-pairs, the energy content of which exceeds a predetermined level.

4. The system defined by claim 2 wherein said thresholding means determines the energy content associated with said pole-pairs and selects a predetermined number of said pole-pairs having the highest energy content.

5. An analyzer for vocoding an input signal comprising:

input means for receiving said input signal and for ordering it into a plurality of frames;

Laplace transform means for determining the frequency, damping rate, phase angle and amplitude of the s-plane poles for each of said frames, coupled to said input means;

energy computation means for determining the energy associated with each pole coupled to said Laplace transform means;

selection means for selecting poles from each frame so as to preserve maximum energy content, coupled to said energy computation means;

whereby the characteristics of those poles associated with the highest energy are preserved for transmission or recording.

6. The analyzer defined by claim 5 wherein said Laplace transform means includes means for obtaining a Fourier transform of a signal.

7. The analyzer defined by claim 6 including function generation means and multiplication means for multiplying each frame by a predetermined function and wherein the results of said multiplication are coupled to said Fourier transform means.

8. The analyzer defined by claim 7 wherein said Laplace transform means includes peak detection means.

9. The analyzer defined by claim 8 wherein said predetermined function is a sine function.

10. A method for coding an analog signal for transmission or recording comprising the steps of:

converting said analog to a plurality of periodic frames of digital signals by an analog-to-digital converter;

transforming each of said frames of digital signals to an s-plane representation by a Laplace transform means;

determining the energy associated with the poles of said s-plane representation for each frame of said digital signal by comparator means; and selecting for transmission or recording those poles having the highest energy content for each frame of said digital signal by a comparator means.

11. The method defined by claim 10 wherein said transforming of said frames of digital signal is performed by computations employing finite differencing.

12. A system for vocoding an input signal for transmission and synthesizing an output signal from the transmitted information comprising:

input means for converting said input signal into a plurality of periodic frames of digital signals;

pole-pair computer means for determining the pole-pair characteristics in the s-plane for said pole-pairs of each frame of said digital signal, said pole-pair computer means being coupled to said input means;

energy detector means, coupled to said pole-pair computer means for selecting for transmission the pole-pair for each frame having the highest energy content;

synthesizing means for receiving said characteristics of said transmitted pole-pair for each frame of said digital signal and for synthesizing an output signal representative of said input signal;

whereby said input signal is transmitted in the form of a plurality of pole-pairs.

13. The system defined by claim 12 wherein said synthesizing means includes at least one recursive filter.

14. The system defined by claim 13 wherein said synthesizing means includes smoothing means for smoothing the output signal.

15. The system defined by claim 12 wherein said characteristics of a predetermined number of pole-pairs are transmitted for each frame of said digital signal.

16. The system defined in claim 15 wherein the frequency, phase angle, amplitude and damping rate are used to characterize each of said pole-pairs.

17. The system defined by claim 6 wherein a plurality of recursive filters are employed in said synthesizing means.

18. The system defined by claim 17 wherein the number of recursive filters employed by said synthesizing means equals the predetermined number of pole-pairs selected for transmission for each frame of said digital signal.

19. The system defined by claim 12 wherein said input means includes gain normalization means for normalizing the amplitudes of said input signal.

20. A vocoder system comprising:

input means for receiving an input signal;

time-domain to frequency-domain transformation means coupled to said input means for determining s-plane pole locations and residues for said input signal and for providing an output signal containing said pole locations and residues;

selection means coupled to said transformation means for selecting pole locations from said output signal and for providing an output signal containing said selected pole locations and the residues associated therewith; and synthesizing means coupled to said selection means for synthesizing a signal from said output signal containing said selected pole locations and residues;

whereby a signal representative of voice or the like may be stored or transmitted in the form of selected s-plane parameters.

21. The system of claim 20 wherein said selection means includes thresholding means.

22. The system of claim 21 wherein said thresholding means selects pole locations whose energy content exceed a predetermined level.

23. The system of claim 21 wherein said thresholding means determines the energy content associated with said pole locations and selects a predetermined number of said pole locations having the highest energy content.

24. A system for transmitting an input system in a coded form comprising:

input means for receiving said input signal;

time-domain to frequency-domain transformation means coupled to said input means for determining s-plane pole locations and residues for said input signal and for providing an output signal containing said pole locations and residues; and selection means coupled to said transformation means for selecting pole locations from said output signal for transmission;

whereby said input signal may be transmitted in the form of selected s-plane parameters.

25. The system of claim 24 further comprising synthesizing means coupled to said selection means for synthesizing a signal from said selected s-plane parameters.

26. The system of claim 24 wherein said selection means includes thresholding means.

27. The system of claim 26 wherein said thresholding means selects pole locations whose energy content exceed a predetermined level.

28. The system of claim 26 wherein said thresholding means determines the energy content associated with said pole locations and selects a predetermined number of said pole locations having the highest energy content.

29. The system of claim 24 wherein said input means includes means for ordering said input signal into a plurality of frames and said transformation and selection means operate on the portion of said signal contained within each of said frames.

30. The system of claim 24 wherein said system is a vocoder system an said input signal is representative of voice or the like.

31. A method for coding a signal for transmission or recording comprising the steps of:

ordering said signal into a plurality of frames;

transforming each of said frames of signals to an s-plane representation by a Laplace transform means; and selecting for transmission or recording certain ones of the poles of said s-plane representation for each frame of said signal.

32. The method of claim 31 further comprising the step of determining the energy associated with the poles of said s-plane representation for each frame of said signal, said poles having the highest energy content being selected for transmission or recording.

* * * * *